US005553571A

United States Patent [19]

Campbell et al.

[11] Patent Number: 5,553,571

[45] Date of Patent: Sep. 10, 1996

[54] RAPPABLE STEAM GENERATOR TUBE BANK

[75] Inventors: Walter R. Campbell, Union; John W. Phalen, Somerville, both of N.J.; Stephen J. Goidich, Palmerton, Pa.

[73] Assignee: Foster Wheeler Energy Corporation, Clinton, N.J.

[21] Appl. No.: 350,574

[22] Filed: Dec. 7, 1994

[51] Int. Cl.[6] ..... F22B 37/18

[52] U.S. Cl. ..... 122/379; 122/393; 165/84; 165/95

[58] Field of Search ..... 122/379, 393; 165/84, 95

[56] References Cited

U.S. PATENT DOCUMENTS

| | | | |
|---|---|---|---|
| 600,059 | 3/1898 | Brady | 122/393 |
| 3,997,000 | 12/1976 | Piela | 122/379 |
| 4,294,200 | 10/1981 | Gorzegno . | |
| 4,301,771 | 11/1981 | Jukkola et al. . | |
| 4,442,880 | 4/1984 | Seifert et al. . | |
| 4,809,625 | 3/1989 | Garcia-Mallol et al. . | |
| 4,836,146 | 6/1989 | Russel et al. | 122/379 |
| 4,878,654 | 11/1989 | Carminati et al. . | |
| 4,888,158 | 12/1989 | Downs . | |
| 5,315,966 | 5/1994 | Gamache et al. | 122/379 |

*Primary Examiner*—Henry A. Bennett
*Assistant Examiner*—Siddaarth Ohri
*Attorney, Agent, or Firm*—Haynes and Boone, L.L.P.

[57] ABSTRACT

An apparatus and method of operating a steam generator tube bank are disclosed in which a water drum of a typical steam drum/water drum combination is replaced with a plurality of smaller readers to permit the use of rapping, or mechanical rappers, to clean the tubes extending between the steam drum and the headers. The steam generator tube bank of the present invention comprises a steam drum or collecting header, a plurality of headers extending below the steam drum, and a plurality of tubes extending between the steam drum and the headers and placing the steam drum and headers in fluid flow communication. The headers are sized to permit debris or deposits which accumulate on the tubes to be removed by rapping the headers, thereby inducing vibration of the headers and the tubes. The tubes are arranged in rows, and the headers are arranged to form rows of axially-aligned pairs of headers. A mechanical rapper is associated with each header to periodically strike the header and induce vibration of the header and tubes connected thereto to remove debris and deposits which may have accumulated on the tubes.

12 Claims, 2 Drawing Sheets

RAPPABLE STEAM GENERATOR TUBE BANK

BACKGROUND OF THE INVENTION

This invention relates to an apparatus and method of operating a steam generator tube bank and, more particularly, to such an apparatus and method in which debris and deposits are removed from the tube bank by inducing vibration of the tubes of the tube bank.

Steam generator tube banks are well known in the art. Particularly in a fluidized bed reactors a hot, particulate-containing gas stream is passed across such steam generator tube banks to heat a cooling fluid flowing through the tubes. The main purpose of the tube bank is to provide for heat transfer to the cooling fluid, however, as a result of their location, these tube banks act to remove a portion of the particulate material from the gas stream as a portion of the particulate material strikes the tubes and adheres thereto or falls out of the gas stream.

Steam generator tube banks typically include a steam drum, a plurality of tubes extending downwardly from the steam drum to form a tube bank, and a water or "mud" drum located below the steam drum and receiving the cooling fluid from the tube bank. From the water drum, the cooling fluid is then returned to the steam drum or circulated to other portions of the fluid flow circuitry of the reactor for further heat transfer to the cooling fluid.

Such steam generator tube banks provide advantages such as increasing heat transfer from flue gases and decreasing the amount of particulate material in such flue gases. However, such steam generator tube banks are not without problems. For example, as particulate material adheres to the surfaces of the tubes, the heat transfer to the cooling fluid decreases. Excessive buildup may also impede gas flow and increase the pressure drop across the tube bank.

In other applications, mechanical rappers have proven to be effective in removing deposits from tubes. However, the bulk, mass, and rigidity of the steam drum and the water drum make rapping ineffective as a means for cleaning such steam generator tube banks. Accordingly, these deposits are typically removed using a sootblower or other less desirable method.

SUMMARY OF THE INVENTION

It is therefore an object of the present invention to provide an apparatus and method of operating a steam generator tube bank in which deposits of particulate material may be removed from the tubes by inducing vibration of the tubes.

It is a further object of the present invention to provide an apparatus and method of operating a steam generator tube bank in which a plurality of headers are provided for receiving cooling fluid from the tubes.

It is a still further object of the present invention to provide an apparatus and method of the above type in which particulate material may be removed from the tubes by rapping the headers to induce vibration of the tubes.

It is a still further object of the present invention to provide an apparatus and method of the above type in which mechanical rappers are used for rapping the headers to induce vibration of the tubes.

It is a still further object of the present invention to provide an apparatus and method of the above type in which the headers are formed into a plurality of rows of axially-aligned pairs to enhance the effectiveness of rapping for removing deposits from the tubes.

It is a still further object of the present invention to provide an apparatus and method of the above type in which flexible feeders connect the headers to downcomers without significantly impeding the ability of the headers to vibrate along their axes.

It is a still further object of the present invention to provide an apparatus and method of the above type in which the flexible feeders extend below and parallel to the headers so that the feeders are out of the path of falling debris or deposits removed from the tubes.

It is a still further object of the present invention to provide an apparatus and method of the above type in which the tubes are formed into a plurality of rows and in which each header is connected to the rows of tubes to enhance the efficiency of rapping for removing debris or deposits from the tubes.

It is a still further object of the present invention to provide an apparatus and method of the above type in which the headers are sufficiently spaced to allow ready access to the inner tubes for inspection and maintenance.

Toward the fulfillment of these and other objects, the steam generator tube bank of the present invention comprises a steam drum, a plurality of headers extending below the steam drum, and a plurality of tubes extending between the steam drum and the headers and placing the steam drum and headers in fluid flow communication. The headers are sized to permit debris or deposits which accumulate on the tubes to be removed by rapping the headers, thereby inducing vibration of the headers and the tubes. The tubes are arranged in rows, and the headers are arranged to form rows of axially-aligned pairs of headers. Each header is in fluid flow communication with the rows of tubes. A mechanical rapper is associated with each header to periodically strike the header and induce vibration of the header and tubes connected thereto to remove debris and deposits which may have accumulated on the tubes. Flexible feeders extend downwardly from the headers and connect the headers to downcomers without significantly impeding the ability of the headers to vibrate along their axes.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
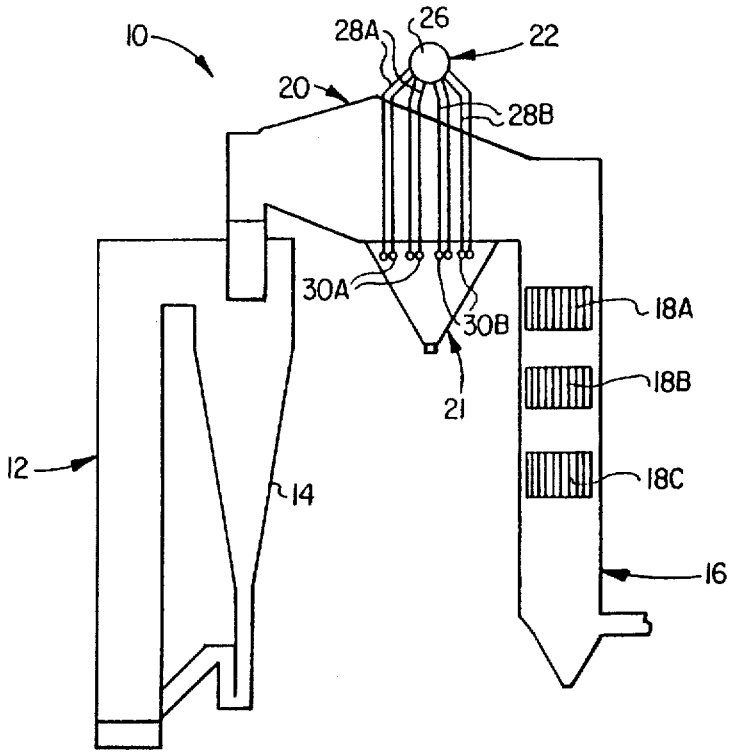
FIG. 1 is an elevation schematic view of a fluidized bed reactor incorporating features of the present invention.

Referring to FIG. 1 of the drawings, the reference numeral 10 refers in general to a fluidized bed reactor of the present invention which includes a furnace 12, a separator 14, and a heat recovery area 16, having heat exchange surfaces 18A, 18B, and 18C. A conduit 20 having a hopper 21 connects the separator 14 to the heat recovery area 16, and a steam generator tube bank 22 is provided in the conduit 20 between the separator 14 and the heat recovery area 16.

Figure 2:
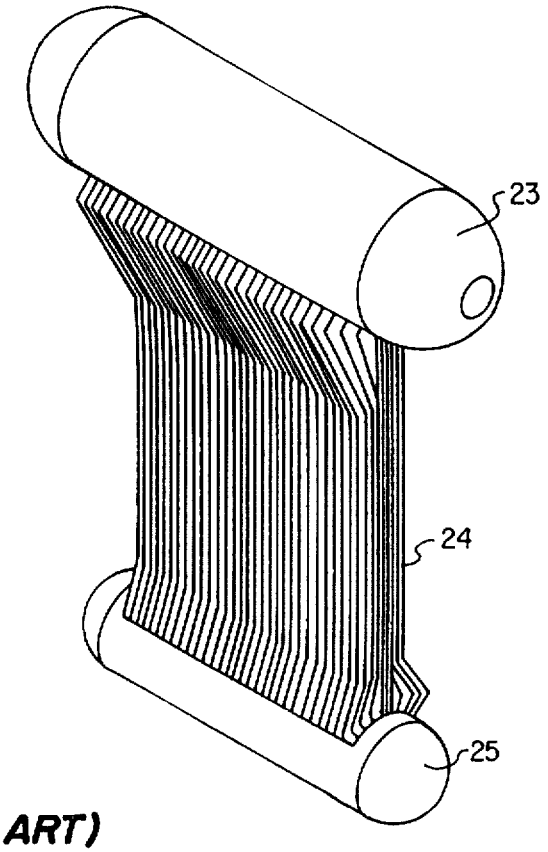
FIG. 2 (PRIOR ART)
FIG. 2 is a schematic representation of a prior art steam generator tube bank.

As discussed in more detail herein, the present apparatus and method provides a number of advantages over prior art steam generator tube banks such as depicted in FIG. 2 which include a steam drum 23 and a plurality of tubes 24 connecting the steam drum to a water or mud drum 25. As discussed above, among the disadvantages of such prior art steam generator tube banks discussed herein, the mass, bulk, and rigidity of the steam drum 23 and water drum 25 make rapping ineffective as a means of removing debris or deposits from the tubes 24.

Figure 3:
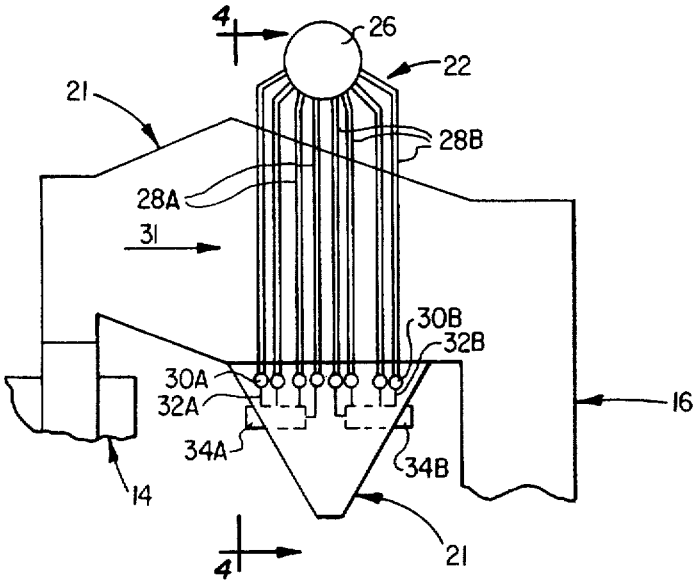
FIG. 3 is an enlarged schematic view of a portion of a fluidized bed reactor incorporating features of the present invention.
Figure 4:
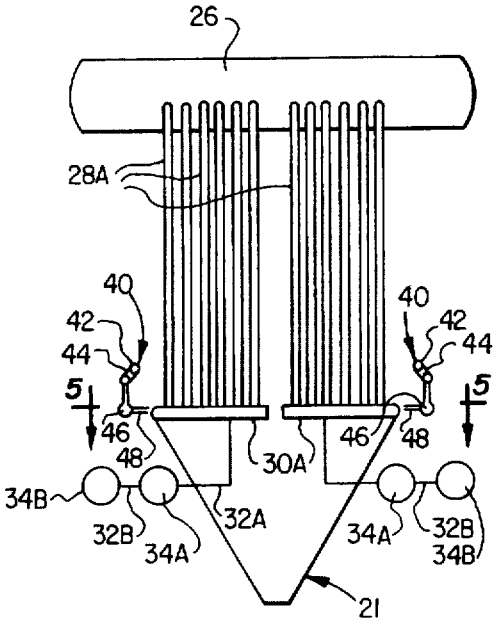
FIG. 4 is a cross-sectional view taken along line 4—4 of FIG. 3.
Figure 5:
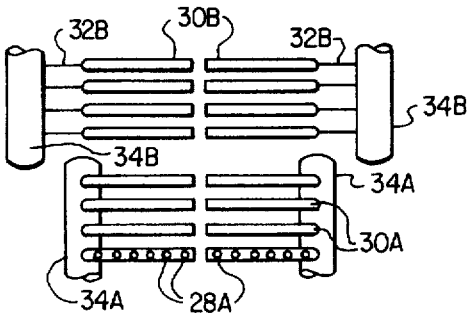
FIG. 5 is a cross-sectional view taken along line 5—5 of FIG. 4.

As shown in FIGS. 3–5, the steam generator tube bank 22 of the present invention comprises a steam drum 26, a plurality of tubes 28A and 28B extending downwardly from the steam drum 26, and a number of headers 30A and 30B connected at the lower ends of the riser tubes 28A and 28B. Thus the steam drum 26, the riser tubes 28A and 28B, and the headers 30A and 30B are in fluid flow communication for passing a cooling fluid, such as water or steam or a water and steam mixture, from the steam drum 26 through the downcomers 34 through the feeders 32 to the headers 30A and 30B, and finally through the riser tubes 28 back to the steam drum 26, or vice versa.

The steam drum 26 is disposed above the conduit 20, and the riser tubes 28A and 28B extend in a spaced relationship and pass through openings formed in the top wall of the conduit 20. Therefore a plurality of spaced rows of tubes 28A and 28B extend through the conduit 20 and normal to the general direction of gas flow through the conduit 20 as shown by the arrow 31. As discussed in detail later, the tubes 28A and 28B are positioned to disrupt the path of gas flowing through the conduit 20 and the alignment of the rows of tubes may be in line or staggered to increase this disruption.

The tubes 28A and 28B are connected at their lower ends to a plurality of spaced parallel, substantially horizontal headers 30A and 30B disposed in the hopper 21 below the conduit 20. As shown in FIG. 5, each header 30A and 30B is connected to one or more rows of tubes 28A and 28B. The headers 30A and 30B form a plurality of rows of axially-aligned pairs extending normal to the gas flow in the conduit 20. The rows of headers 30A and 30B are preferably spaced to allow access to interior rows of tubes 28A and 28B for inspection and maintenance. As shown in FIG. 4 each header 30A and 30B can have a length which is slightly less than half the width of the conduit 20.

A plurality of feeders 32A and 32B respectively connect the headers 30A and 30B to a plurality of downcomers 34A and 34B positioned outside the hopper 21, for passing cooling fluid from the downcomers 34A and 34B to headers 30A and 30B, or vice versa. Each feeder 32A and 32B preferably has a substantially vertical portion extending downwardly from the header 30A and 30B and a substantially horizontal portion extending parallel to and below the respective header 30A and 30B and extending through the hopper 21 to a downcomer 34A and 34B. The vertical portion of each feeder 32A and 32B is of sufficient length and flexibility to connect the headers 30A and 30B to the downcomers 34A and 34B without significantly impeding the ability of the headers 30A and 30B to vibrate along their axes when the headers 30A and 30B are struck. As will be described, this permits debris or deposits to be removed from the tubes 28A and 28B by rapping the headers 30A and 30B or by otherwise imparting vibration to the headers 30A and 30B and the tubes 28A and 28B. The substantially horizontal portion of each feeder 32A and 32B is aligned beneath the respective header 30A and 30B to be out of the path of falling debris or deposits as the debris or deposits are removed from the tubes.

Only a portion of the downcomers 34A and 34B are shown in the drawings. It is understood that the downcomers may extend to other areas of the fluid flow circuitry including the steam drum for circulating cooling fluid to or from other components of the fluid flow circuitry. The portions of the downcomers 34A and 34B shown in FIGS. 3–5 are disposed below the headers 30A and 30B and outside of the conduit 20 and hopper 21. The downcomers 34A and 32A and 32B are in fluid flow communication with the feeders 32A and 32B and may receive cooling fluid from the feeders 32A and 32B for further circulation through the fluid flow circuitry of the reactor. Typically, the downcomers receive cooling fluid from the steam drum 26 or other portions of the fluid flow circuitry and pass the cooling fluid through the feeders 32A and 32B, to the headers 30A and 30B, the tubes 28A and 28B, and back to the steam drum 26.

As shown in FIG. 5, four downcomers 34A and 34B are provided for the current arrangement, each being in fluid flow communication with four or more feeders 32A and 32B which respectively extend to the headers 30A and 30B. Although it may not be apparent from the drawings, the front part of the boiler bank is thirteen tubes wide arranged in two rows of tubes 28A for each of the headers 30A forming the front four rows of headers 30A. The rear part of the boiler bank is twenty tubes wide and two rows of tubes 28B are connected to each of the headers 30B forming the rear four rows of headers 30B. Hence, the tube spacing need not be uniform for the entire boiler bank. This provides greater operational flexibility and greater control over heat exchange rates, flue gas temperatures, and cooling fluid temperatures as well as facilitates tube cleaning.

As shown in FIG. 4, mechanical tappers 40 are provided outside of the conduit 20 for rapping the headers 30A and 30B to induce vibration of the headers 30A and 30B and the tubes 28A and 28B for removing debris or deposits which may have accumulated on the tubes 28A and 28B. The mechanical rappers 40 include a drive shaft 42, an arm 44 connected to each drive shaft 42, and a hammer 46 pivotally connected to the arm 44. Rods 48 are supported so that they extend into the conduit 20 and are aligned with the headers 30A and 30B so that the rods 48 will impact the ends of the headers 30A and 30B when struck by the hammers 46. The time interval between rapping and the number of rapping rotations may be controlled to vary the duration and intensity of rapping as desired. Because mechanical rappers are well known in the art, they will not be described or depicted in further detail. It is understood that, although preferred, mechanical rappers 40 need not be provided. Instead, the headers 30A and 30B may be struck or rapped manually, or the headers 30A and 30B and tubes 28A and 28B may be induced to vibrate by any conventional means including mechanical, electro-mechanical or sonic.

In operation, fuel and an oxygen-containing fluidizing gas, such as air, are provided in the furnace 12 (FIG. 1) to form a fluidized bed. The fuel is combusted and the heat of combustion is transferred to a cooling fluid passing through fluid flow circuitry of the reactor 10. Hot flue gases containing particulate materials pass to the separator 14, preferably a cyclone separator, in which a majority of the particulate material is separated from the flue gases. The separated particulate material may be recycled to the furnace 12 or sent to disposal. The separated flue gases pass from the separator 14 to the conduit 20. Although a majority of the particulate material has been removed, a small amount of fine particulate material passes with the flue gas into the conduit 20.

As best shown in FIGS. 3–5, cooling fluid such as water or steam or a water and steam mixture, is circulated through fluid flow circuitry of the reactor which may include the steam drum 26, the tubes 28A and 28B, the headers 30A and 30B, the feeders 32A and 32B, and the downcomers 34A and 34B, and which may also include heat exchange surfaces 18A, 18B, and 18C (FIG. 1), and finned tube walls (not shown) which form the walls of the furnace 12, separator 14, conduit 20 and heat recovery area 16. The cooling fluid may pass from the steam drum 26 to the downcomers 34A and 34B, then via the feeders 32A and 32B to the headers 30A and 30B. Cooling fluid would then flow upward through the tubes 28A and 28B to the steam drum 26 completing the loop. Alternatively, as mentioned above, the direction of flow of the cooling fluid may also be reversed. The cooling fluid may be returned to the steam drum 26 or may be further circulated to other portions of the fluid flow circuitry of the reactor before being returned to the steam drum 26.

The hot flue gases and fine particulate materials which have passed from the separator 14 and into the conduit 20 are passed across the tubes 28A and 28B which are disposed in rows across the conduit 20. Heat is transferred from the flue gases and fine particulate material to the cooling fluid passing through the tubes 28A and 28B. Portions of the fine particulate material in the flue gases strike the tubes 28A and 28B and fall out of the flue gas stream into the hopper 21 where the separated fine particulate material may be recycled or sent to disposal. Additionally, portions of the fine particulate material strike and adhere to the tubes 28A and 28B, forming debris or deposits which impair heat transfer to the cooling fluid in the tubes 28A and 28B and which may impede passage of the flue gases through the conduit 20.

As deposits begin to form on the tubes 28A and 28B and the conduit 20, vibrations are imparted to the tubes 28A and 28B to remove deposits from the tubes 28A and 28B. The deposits fall from the tubes 28A and 28B to the hopper 21 and are recycled or sent to disposal. These vibrations are imparted to the tubes 28A and 28B by the mechanical rappers 40 which strike the headers 30A and 30B to induce vibration of the headers 30A and 30B and the connected tubes 28A and 28B. It is understood that other conventional means of inducing vibration of the tubes 28A and 28B may be used, such as manually rapping the headers 30A and 30B. Additionally, the vibration of the tubes 28A and 28B may be induced as desired, such as at regular intervals, and the frequency and degree of vibration may be adjusted as desired.

Several advantages result from the foregoing apparatus and method. For example, the present apparatus and method permits debris or deposits to be removed from the tubes of a steam generator tube bank 22 by inducing vibration of the tubes 28A and 28B. The use of a plurality of headers 30A and 30B in place of a heavier and more rigid water drum enables the use of rapping, and more particularly the use of mechanical rappers 40, to induce the vibration of the tubes 28A and 28B. Additionally, the use of a plurality of pairs of axially-aligned headers 30A and 30B permits the use of and enhance the effectiveness of rapping, particularly by the mechanical rappers 40. The flexible feeders 32A and 32B permit the headers 30A and 30B to be connected to the downcomers 34A and 34B without significantly impeding the ability of the headers 30A and 30B to vibrate along their axes. Further, the spacing of the headers 30A and 30B enhances access to the inner tubes 28A and 28B for inspection or maintenance.

It is understood that variations may be made in the apparatus and method of the present invention without departing from the scope of the present invention. For example, although the steam generator tube bank 22 is depicted as being disposed in the conduit 20 between the separator 14 and the heat recovery area 16 of a fluidized bed reactor 10, the steam generator tube bank 22 may be used in other portions of the reactor 10 or in other apparatus. Similarly, although mechanical rappers 40 are preferably used to rap the headers 30A and 30B, other means may be used to rap the headers 30A and 30B or to otherwise induce vibration of the tubes 28A and 28B. Additionally, although the present apparatus and method depict rapping as the sole method of removing debris or deposits from the tubes 28A and 28B, it is understood that rapping may be used alone or in combination with other apparatus or methods. Further, the number and specific locations of the tubes, the headers, the feeders, and the downcomers may be varied. For example, any number of rows of tubes 28A and 28B may be connected to each header 30A and 30B as long as the resultant tube bank remains flexible enough to permit cleaning by rapping. However, the preferred arrangement shown has only two rows of tubes 28A and 28B connected to each header 30A and 30B.

Other modifications, changes and substitutions are intended in the foregoing disclosure and in some instances some features of the invention will be employed without a corresponding use of other features. Various modifications to the disclosed embodiment as well as alternative applications of the invention will be suggested to persons skilled in the art by the foregoing specification and drawings. Accordingly, it is appropriate that the appended claims be construed broadly and in a manner consistent with the scope of the invention therein.

What is claimed is:

1. A steam generator tube bank comprising:

a steam drum;

a plurality of spaced rows of tubes in fluid flow communication with said steam drum and extending downwardly from said steam drum; and a plurality of rows of headers extending below and substantially parallel to said steam drum;

said tubes extending to said headers to place said headers into fluid flow communication with said steam drum;

said headers being sized to permit deposits accumulating on said plurality of tubes to be removed from said tubes by inducing vibration of said headers and said tubes.

2. A steam generator tube bank comprising:

a steam drum;

a plurality of rows of tubes in fluid flow communication with said steam drum and extending downwardly from said steam drum;

a plurality of rows of headers disposed below said steam drum, to place said headers into fluid flow communication with said steam drum, said headers being sized to permit deposits accumulating on said tubes to be removed from said tubes by inducing vibration of said headers and said tubes; and a plurality of mechanical rappers disposed in a spaced relationship to said headers for striking said headers to induce vibration of said headers and said tubes for removing deposits from said tubes.

3. The steam generator tube bank of claim 1 further comprising:

a least one downcomer, a portion of which is disposed below said plurality of headers; and a plurality of feeders connecting each of said plurality of headers to said at least one downcomer, placing said plurality of headers in fluid flow communication with said at least one downcomer.

4. The steam generator tube bank of claim 1 wherein said plurality of headers are disposed to form a plurality of rows of spaced, axially-aligned pairs of headers.

5. The steam generator tube bank of claim 1 further comprising means for inducing vibration of said plurality of headers and said plurality of tubes for removing deposits from said plurality of tubes.

6. The steam generator tube bank of claim 1 or 2 wherein said steam drum is replaced by at least one collecting header.

7. The steam generator tube bank of claim 2 wherein said plurality of headers are disposed within said hopper below said conduit.

8. The steam generator tube bank of claim 7 wherein said at least one downcomer extends adjacent to and outside of said hopper, below said plurality of headers.

9. The steam generator tube bank of claim 8 wherein each of said plurality of feeders comprises a first, flexible, substantially vertical portion extending downwardly from said plurality of headers in said hopper, and a second portion extending outwardly from said first portion to said at least one downcomer, outside of said hopper, said first portion being of sufficient length and flexibility to permit significant axial vibration of said plurality of headers when said plurality of headers are struck, and said second portion being aligned beneath said plurality of headers.

10. The steam generator tube bank of claim 4 wherein:

said plurality of rows of axially-aligned headers comprises a first, front plurality of rows and a second, rear plurality of rows;

said plurality of tubes comprises a first plurality of rows of tubes connected to said first plurality of rows of headers and a second plurality of rows of tubes connected to said second plurality of rows of headers; and wherein each of said second plurality of rows of tubes has a greater number of tubes than each of said first plurality of rows of tubes.

11. The steam generator tube bank of claim 1 wherein each row of headers comprises at least two spaced, axially-aligned headers.

12. A steam generator tube bank comprising:

a steam drum;

a plurality of tubes in fluid flow communication with said steam drum and extending downwardly from said steam drum; and a plurality of headers disposed below said steam drum, said tubes extending to said headers to place said headers into fluid flow communication with said steam drum, said headers being sized to permit deposits accumulating on said tubes to be removed from said tubes by inducing vibration of said headers and said tubes;

a least one downcomer a portion of which is disposed below said headers;

a plurality of feeders connecting each of said headers to said at least one downcomer to place said headers in fluid flow communication with said at least one downcomer;

a conduit extending below said steam drum for passing particulate-containing gases between components of a reactor; and a hopper connected to said conduit and extending below at least a portion of said conduit;

at least a portion of said tubes extending through said conduit above said hopper and being in heat transfer communication with said particulate-containing gases passing through said conduit.

* * * * *

UNITED STATES PATENT AND TRADEMARK OFFICE

CERTIFICATE OF CORRECTION

PATENT NO. : 5,553,571

DATED : September 10, 1996

INVENTOR(S) : Walter R. Campbell, John W. Phalen, Stephen J. Goidich

It is certified that error appears in the above-indentified patent and that said Letters Patent is hereby corrected as shown below:

On the title page item [57],

Line 4, after "smaller" delete "readers" and insert --headers--.

Signed and Sealed this

Tenth Day of December, 1996

*Attest:*

Bruce Lehman

BRUCE LEHMAN

*Attesting Officer*

*Commissioner of Patents and Trademarks*